US005762775A

United States Patent [19]

DePaoli et al.

[11] Patent Number: 5,762,775

[45] Date of Patent: Jun. 9, 1998

[54] METHOD FOR ELECTRICALLY PRODUCING DISPERSIONS OF A NONCONDUCTIVE FLUID IN A CONDUCTIVE MEDIUM

[75] Inventors: David W. DePaoli, Knoxville; Constantinos Tsouris, Oak Ridge, both of Tenn.; James Q. Feng, Fairport, N.Y.

[73] Assignee: Lockheed Martin Energy Systems, Inc., Oak Ridge, Tenn.

[21] Appl. No.: 751,180

[22] Filed: Nov. 15, 1996

Related U.S. Application Data

[63] Continuation-in-part of Ser. No. 309,851, Sep. 21, 1994, abandoned.

[51] Int. Cl.[6] ..... B01F 3/08

[52] U.S. Cl. ..... 204/554; 239/3; 204/671

[58] Field of Search ..... 204/554, 555, 204/556, 558, 559, 670, 671; 239/3, 290, 300, 324, 690, 690.1, 692

[56] References Cited

U.S. PATENT DOCUMENTS

| | | | |
|---|---|---|---|
| 4,439,980 | 4/1984 | Biblarz et al. | 60/39.06 |
| 4,508,265 | 4/1985 | Jido | 239/3 |
| 4,767,515 | 8/1988 | Scott et al. | 204/186 |
| 4,767,929 | 8/1988 | Valentine | 250/370.07 |
| 4,941,959 | 7/1990 | Scott | 204/186 |
| 5,122,360 | 6/1992 | Harris et al. | 423/592 |
| 5,207,973 | 5/1993 | Harris et al. | 266/170 |
| 5,262,027 | 11/1993 | Scott | 204/186 |

OTHER PUBLICATIONS

M. Sato, et al., "Emulsification and Size Control of Insulating and/or Viscous Liquids in Liquid–Liquid Systems by Electrostatic Dispersion", *Journal of Colloid and Interface Science*, Academic Press, 156, pp. 504–507 (1993) no month available.

*Primary Examiner*—Kathryn L. Gorgos
*Assistant Examiner*—William T. Leader
*Attorney, Agent, or Firm*—Jeffrey N. Cutler

[57] ABSTRACT

A method for use in electrically forming dispersions of a nonconducting fluid in a conductive medium that minimizes power consumption, gas generation, and sparking between the electrode of the nozzle and the conductive medium. The method utilizes a nozzle having a passageway, the wall of which serves as the nozzle electrode, for the transport of the nonconducting fluid into the conductive medium. A second passageway provides for the transport of a flowing low conductivity buffer fluid which results in a region of the low conductivity buffer fluid immediately adjacent the outlet from the first passageway to create the necessary protection from high current drain and sparking. An electrical potential difference applied between the nozzle electrode and an electrode in contact with the conductive medium causes formation of small droplets or bubbles of the nonconducting fluid within the conductive medium. A preferred embodiment has the first and second passageways arranged in a concentric configuration, with the outlet tip of the first passageway withdrawn into the second passageway.

16 Claims, 3 Drawing Sheets

METHOD FOR ELECTRICALLY PRODUCING DISPERSIONS OF A NONCONDUCTIVE FLUID IN A CONDUCTIVE MEDIUM

This application in part discloses and claims subject matter disclosed in our earlier filed pending application, Ser. No. 08/309,851, filed on Sep. 21, 1994.

This invention was made with Government support under Contract DE-AC05-840R21400 awarded by the United States Department of Energy to Lockheed Martin Energy Systems, Inc., and the U.S. Government has certain rights in this invention.

TECHNICAL FIELD

The present invention relates to a method for using an apparatus in the electrical dispersion of one fluid into a second fluid, and more particularly for use with a nozzle for introducing the first fluid into the second without deleterious electrical discharges. Such a nozzle permits the creation, by electrical means, of a dispersion of a non-conducting fluid in a conductive medium without undue electrical sparking.

BACKGROUND ART

The introduction of fluids through a nozzle into a second fluid, with the application of an electrical potential difference (usually pulsed and typically up to a few kV) between the nozzle and an electrode within the second fluid (often the container for the second fluid), has become a rather common technology. For example, very small droplets of the first fluid (usually a liquid or slurry) can be formed in the second fluid whereby various chemical reactions take place. In one application, very small spheres of a solid product are formed by reactions between a feed solution (slurry) and reaction fluid (the second fluid) whereby the chemical reaction produces solid particles. In other applications, the technique can be used to transfer chemical substances between fluids by extraction. The general art is discussed, for example, in "Electrostatic Spraying of Liquids", Adrian G. Bailey, Research Press, Ltd., England, 1988.

Other references dealing with this technology are U.S. Patent Numbers:

| U.S. Pat. No. | Inventor(s) | Issue Date |
|---|---|---|
| 4,439,980 | O. Biblarz, et al. | Apr. 3, 1984 |
| 4,508,265 | M. Jido | Apr. 2, 1985 |
| 4,767,515 | T. C. Scott, et al. | Aug. 30, 1988 |
| 4,767,929 | K. H. Valentine | Aug. 30, 1988 |
| 4,941,959 | T. C. Scott, et al. | July 17, 1990 |
| 5,122,360 | M. T. Harris, et al. | June 16, 1992 |
| 5,207,973 | M. T. Harris, et al. | May 4, 1993 |
| 5,262,027 | T. C. Scott | Nov. 16, 1993 |

Of these references, the '265 patent issued to Jido discloses a method for simultaneously mixing and spraying two liquids. The device disclosed therein includes an inner tube having a conically-shaped discharge section. The device is ultimately used for spraying a conductive fluid into a non-conductive fluid, or more generally, a more-conductive fluid into a less-conductive fluid, and spraying both into the atmosphere. Jido does not teach a method for using the apparatus disclosed in the '265 patent for introducing a non-conductive (or less-conductive) fluid into a conductive (or more-conductive) fluid. As a result, Jido fails to teach a method for spraying a conductive fluid into a buffer fluid such as water, the buffer fluid (non-conductive) serving to prevent sparking between the high voltage fluid (conductive) and a low-voltage fluid (water).

Neither the publication cited above, nor any of the cited patents, discuss electrical dispersion of fluids into a conductive medium. The problem that is encountered, if an electrical dispersion is attempted into a conductive medium is the large magnitude of electrical current or even intense arcing between the nozzle and the conductive surrounding medium. This prevents any meaningful dispersion, if at all.

Only one reference is known that describes an attempt to electrically disperse a nonconductive fluid into a low conductive medium. The publication is that by Masayuki Sato, et al., "Emulsification and Size Control of Insulating and/or Viscous Liquids in Liquid-Liquid Systems by Electrostatic Dispersions", *J. of Colloid and Interface Science,* 156 (1993), pp. 504–507. The device shown and described in that reference utilizes a glass insulator surrounding all of a metallic nozzle except the very tip. Dispersions of various nonconductive fluids into distilled water are discussed. However, when any material is present in the water to raise the conductivity, significant power consumption, gas production and even sparking then occurs.

Accordingly, it is an object of the present invention to provide a method for introducing a nonconductive fluid into a conducting medium in the form of fine bubbles or droplets, using a nozzle having an electrical potential applied thereto, the method yielding the prevention of significant power consumption, gas production and deleterious sparking between the nozzle and an element of opposite polarity in contact with the conducting medium.

Another object of the present invention is to provide a nozzle construction, for use in the present method, wherein the nonconducting fluid is injected through the nozzle together with a low conductivity fluid, herein termed an electrical buffer fluid, to provide an electrically less conductive region surrounding the tip of the nozzle to prevent sparking, the electrical buffer fluid being miscible with the conductive fluid.

A further object of the present invention is to provide a nozzle construction, for use in the present method, wherein the nonconducting fluid is injected axially through the nozzle and a low conductivity electrical buffer fluid is introduced coaxially to the flow of nonconductive fluid to provide a low conductivity region surrounding the tip of the nozzle to prevent sparking.

It is also an object of the present invention to provide a nozzle construction for use in the present method to electrically produce dispersions of an organic fluid, or any gas, in an aqueous medium, such as tap water, under conditions that essentially no electrical sparking occurs between the nozzle tip and the aqueous phase due to the flow of electrical buffer fluid to form a low conductivity region surrounding the nozzle tip.

Also, it is an object of the present invention to provide a method for electrically producing dispersions, using an injection nozzle, of a nonconductive fluid into a conductive medium whereby sparking is prevented between the injection nozzle and the conductive medium.

These and other objects of the present invention will become apparent upon a consideration of the drawings identified below together with a complete description of the invention that follows.

SUMMARY OF THE INVENTION

In accordance with the present invention, a method is disclosed for creating a dispersion of a nonconductive fluid into a conductive fluid. The method of the present invention is carried out using a nozzle constructed for such introduction of a nonconducting fluid into a conducting medium, with an electrical potential applied between the nozzle and the conducting medium, to form small droplets or bubbles of the nonconducting fluid in the conducting medium. Electrical sparking is prevented by also introducing a second and separate electrical buffer fluid through the nozzle to provide a region of this electrical buffer fluid around the tip of the nozzle to prevent the sparking. The electrical buffer fluid is chosen that is miscible with the conducting medium. In a preferred embodiment, the electrical buffer fluid is introduced through a channel that is coaxial with the channel for introduction of the feed nonconducting fluid. This permits, for example, the creation by electrical means, of a dispersion of organic droplets in an aqueous medium.

BESTS MODE FOR CARRYING OUT THE INVENTION

Figure 1:
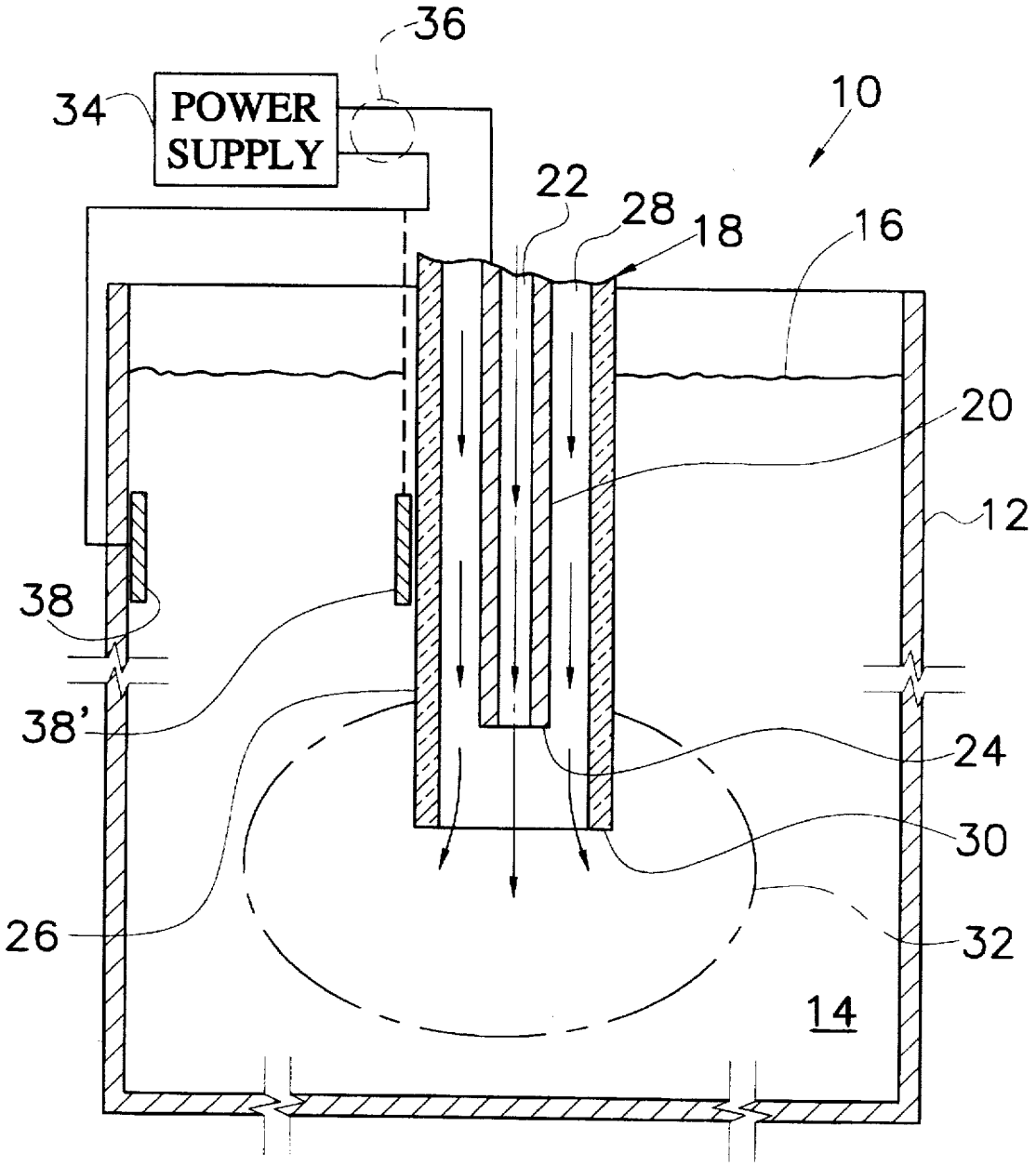
FIG. 1 is a schematic drawing of a system wherein the present invention is utilized.

A system for the utilization of the present invention is shown schematically in FIG. 1 at 10. A selected vessel 12, which can be open-topped (as shown) or closed, contains a conductive medium 14, such as tap water, to a selected level indicated at 16. Mounted by any suitable means (not shown) in the vessel 12 is a nozzle assembly 18 which is described in detail with regard to FIG. 2. Briefly, the nozzle assembly 18 has a metallic (or other highly conductive) conduit or tube 20 having a bore 22 for the introduction of a given feed fluid, droplets or bubbles of which are to be formed within the conductive medium 14. If the feed fluid has a lower density than the conducting medium, the nozzle assembly 18 is introduced into the bottom of the vessel 12. The nozzle assembly has a distal end 24 and, in the preferred form, has an external insulating cover 40 (see FIG. 2). Mounted in a coaxial relationship to the tube 20 is a sleeve 26 to provide an annular passageway 28 for the passage of an electrical buffer fluid that is miscible with the conductive medium. If this sleeve 26 is to be insulating, it can be fabricated of glass or equivalent. This sleeve 26 has a distal end 30 to extend beyond distal end 24 of tube 20 into the conductive fluid 14. With the flow of this electrical buffer fluid, there is formed an electrical buffer region 32 surrounding the tip of the nozzle assembly 18. Although a coaxial arrangement of tube 20 and sleeve 26 is illustrated, and preferred, other arrangements to introduce the buffer fluid will be known to persons skilled in the art. For example, a ring of orifices (not shown) surrounding the distal end 24 could be used to create the electrical buffer region 32.

To achieve an electrical dispersion, a high voltage power supply 34, through leads 36, applies a potential difference between the tube 20 and the conductive medium 14. This is achieved using an electrode 38 located at the wall of the vessel 12 or at any location 38', within the medium 14. For convenience, the sleeve 26 can be fabricated from a conductive material, e.g., a metal, to form the needed electrode with connection being made thereto with an alternate combination of leads 36'. Further, if the vessel 12 is made of a conductive material, its wall can serve as the electrode.

Figure 2:
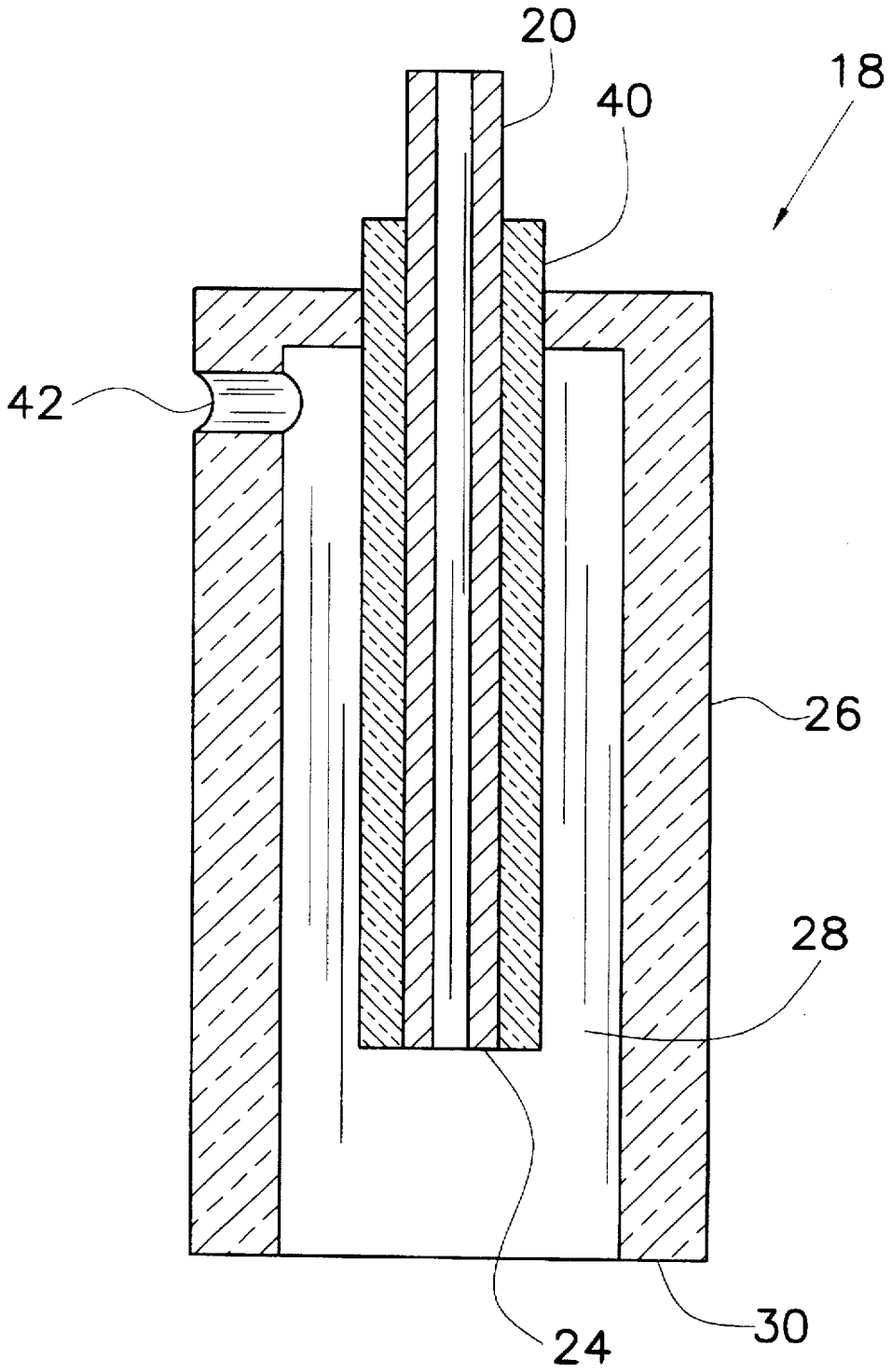
FIG. 2 is a generally schematic, and enlarged, drawing of a nozzle assembly according to one embodiment of the present invention.

Greater detail of the nozzle assembly 18 is shown in the enlarged view of FIG. 2. This drawing, as well as FIG. 1, is not to scale; rather, the components just show the principle of the invention. The tube 20 is typically a metallic capillary, such as a hypodermic needle, closely received in an insulating sheath 40 from a material such as a ceramic. With this construction, only the inside surface and the distal end 24 of the tube 20 are not covered by insulating material. This permits strong electrostatic fields to be maintained within the nonconducting fluid at the distal end 24. Typically, the tube 20 is 1/32" OD stainless steel, with an ID of about 0.02", and the surrounding ceramic sheath 40 is 1/16" OD. Larger drop or bubble size are produced with larger inside and outside diameters of the tube 20. The tube 20 can be positioned variably within the insulating sheath 40 such that the distal end 24 and the tip of the insulating sheath 40 may be adjusted with regard to fluid properties. In the preferred embodiment, the tube-sheath combination is mounted on the axis of a cylindrical outer tube 26 fabricated from glass, for example, with a spacing to provide the annulus 28. The outer tube 26 can also be fabricated from a plastic (Teflon™) or a combination of glass and plastic. The material must be chemically inert to each fluid, and not preferentially wetted by, the nonconductive fluid. An inlet 42 to the annulus is provided through the side of the tube 26, although other positioning of the inlet 42 is within the scope of the invention. Typically the distal end 30 of the outer tube 26 extends about 3/16" farther than the distal end 24 of the tube 20. This dimension is adjustable with regard to fluid properties.

Figure 3:
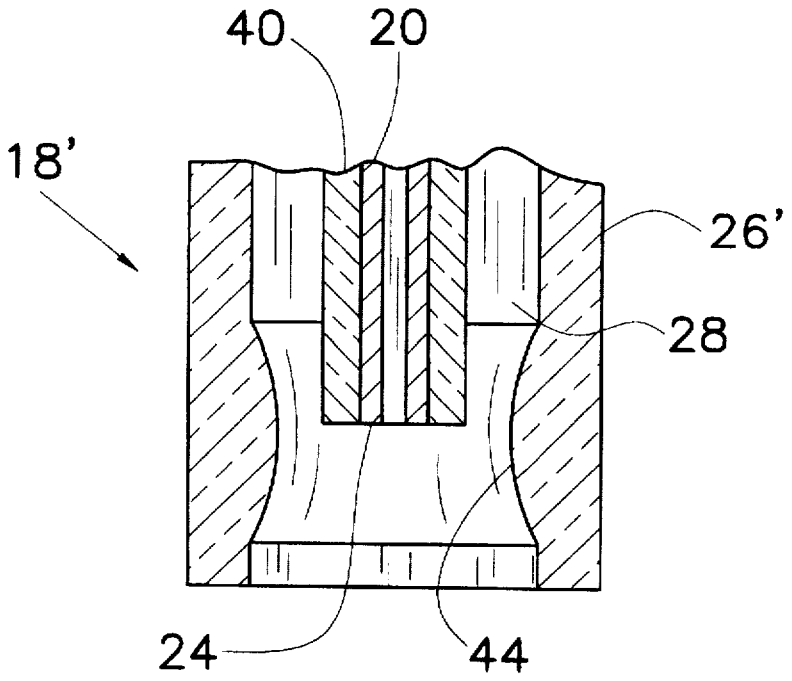
FIG. 3 is an enlarged cross-section of a portion of a further embodiment of the present invention.

During the testing of the device of FIG. 2 some coalescing of droplets occurred upon the inner surface of the outer tube under reduced flow rate of the electrical buffer fluid. A modification 18, of the structure to alleviate the problem is illustrated in FIG. 3. In this embodiment, the outer tube 26' is formed internally with a constriction 44 to create a venturi region and thus increase the velocity of the buffer fluid in the vicinity of the distal end 24 of tube 20.

Figure 4:
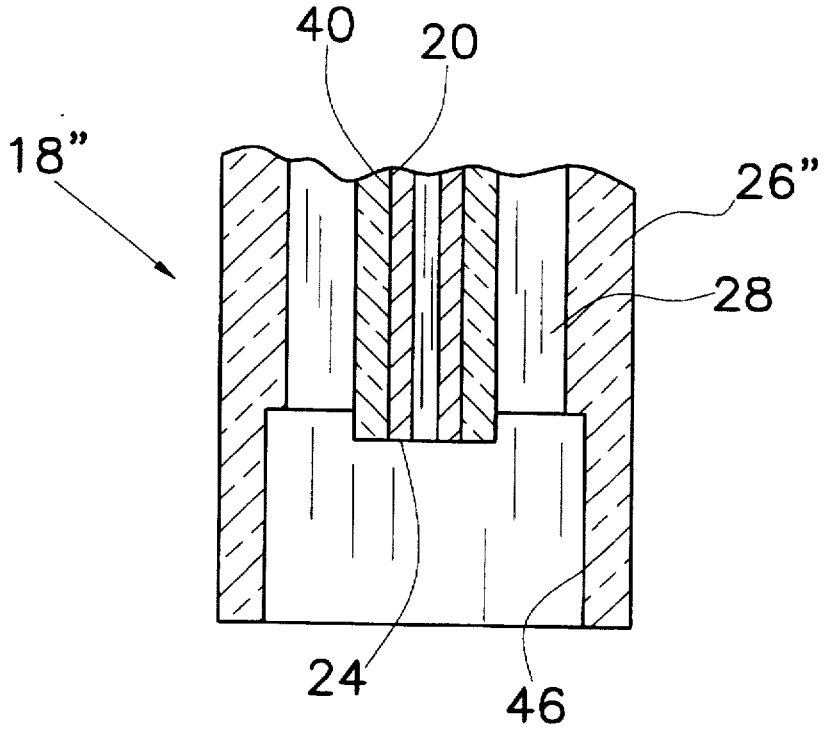
FIG. 4 is an enlarged cross-section of a portion of another embodiment of the present invention.

Similar improvement can be made by increasing the interior diameter, as at 46, of the outer tube 26" adjacent the distal end 24. One such construction is illustrated at 18" in FIG. 4.

Tests were conducted using a nozzle assembly such as illustrated in FIG. 2. It was constructed using the materials and sizes set forth above. These tests were conducted using trichloroethylene (TCE) as the nonconducting feed fluid, tap water as the conducting medium, and distilled water as the electrical buffer fluid. The flow rate of the electrical buffer fluid (distilled water) was varied from about 3.5 ml/min to about 40 ml/min. The flow rate for the TCE was 0.5 ml/min for all tests. The voltage was varied from a few kV up to about 17 kV, with this being pulsed at 400–600 Hz. Smaller size bubbles or drops are created by the higher voltage. Using AC or pulsed voltage offers the advantage of adjustment of frequency for increased energy efficiency; however, DC voltage can be successfully used.

Optimum operation was achieved with the flow rate of the buffer fluid (distilled water) at about 40 mmin. Performance was acceptable at 10–17 kV, cycled at 400–600 Hz. Satisfactory production of dispersed droplets was maintained during the several minute tests of the apparatus.

From the foregoing, it will be understood by persons skilled in the art that an electrostatic dispersion nozzle structure has been developed to satisfactorily produce dispersions of a nonconductive fluid in a conductive medium. This device thereby permits its application to numerous systems including, but not limited to: liquid-liquid extraction with aqueous continuous phase, organic dispersed phase; aeration of bioreactors; manufacture of fine particles (ceramics, latexes, etc.); water treatment by chlorination, ozonation, air stripping; and rapid dissolution of organics or gases in an aqueous phase.

While certain dimensions, materials of construction and operating conditions are given herein, these are for the purpose of best illustrating the present invention and not for limiting the invention. Rather, the invention is to be limited only by the appended claims and their equivalents when read together with the detailed description.

We claim:

1. A method for electrically forming dispersions of a nonconducting fluid in a conductive medium, said method comprising:

passing the nonconducting fluid through a restricted passageway defined by a first tubular member into the conductive medium, said first tubular member having a first end and a second end, said first end receiving the nonconducting fluid and said second end being disposed within the conductive medium and discharging the nonconducting fluid into the conductive medium;

passing an electrical buffer fluid through an annular passageway having a first end and a second end, said annular passageway defined between said first tubular member and a second tubular member, said first tubular member being received within said second tubular member, said annular passageway first end receiving said electrical buffer fluid and said annular passageway second end being disposed within said conductive medium to a depth greater than said second end of said first tubular member, said electrical buffer fluid forming an electrical buffer region within said conductive medium adjacent said second end of said restricted passageway; and applying a voltage between said first tubular member and said conductive medium to electrically form dispersions of said nonconductive fluid in said conductive medium.

2. The method of claim 1 wherein said first tubular member is provided with a central bore of substantially uniform cross-section from said first end to said second end.

3. The method of claim 1 wherein said first tubular member includes a metallic tubular member having first and second ends and an insulating casing around said metallic tubular member and extending to said second end of said metallic tubular member to insulate an exterior side surface of said metallic tubular member from the conductive medium.

4. The method of claim 3 wherein said insulating casing is a ceramic sleeve closely receiving said metallic tubular member.

5. The method of claim 1 wherein said first tubular member is a cylindrical body having an unobstructed substantially cylindrical interior bore, and wherein said second tubular member is a cylindrical body having an interior bore, said interior bore of said second tubular member receiving said first tubular member in coaxial arrangement to define said annular passageway for flow of the electrical buffer fluid.

6. The method of claim 1 wherein said annular passageway is provided with an inwardly-directed ridge proximate said second end of said first tubular member to define a venturi region to induce a velocity increase in the flow of the electrical buffer fluid.

7. The method of claim 1 wherein said annular passageway is provided with an increased cross-sectional area proximate said second end of said first tubular member.

8. The method of claim 1 wherein said first tubular member is conductive whereby substantially no loss of potential occurs between said first end and said second end when a voltage is applied to said first tubular member.

9. The method of claim 1 wherein said second tubular member is fabricated from glass tubing.

10. A method for electrically forming dispersions of a nonconducting fluid in a conductive medium, said method comprising:

passing the nonconducting fluid through a restricted passageway defined by a first tubular member into the conductive medium, said first tubular member having a first end and a second end, said first tubular member being provided with a central bore of substantially uniform cross-section from said first end to said second end, said first end receiving the nonconducting fluid and said second end being disposed within the conductive medium and discharging the nonconducting fluid into the conductive medium, said first tubular member including a metallic tubular member having first and second ends and an insulating casing around said metallic tubular member and extending to said second end of said metallic tubular member to insulate an exterior side surface of said metallic tubular member from the conductive medium, passing an electrical buffer fluid through an annular passageway having a first end and a second end, said annular passageway defined between said first tubular member and a second tubular member, said first tubular member being received within said second tubular member, said annular passageway first end receiving said electrical buffer fluid and said annular passageway second end being disposed within said conductive medium to a depth greater than said second end of said first tubular member, said electrical buffer fluid forming an electrical buffer region within said conductive medium adjacent said second end of said restricted passageway; and applying a voltage between said first tubular member and said conductive medium to electrically form dispersions of said nonconductive fluid in said conductive medium.

11. The method of claim 10 wherein said first tubular member is a cylindrical body having an unobstructed substantially cylindrical interior bore, and wherein said second tubular member is a cylindrical body having an interior bore, said interior bore of said second tubular member receiving said first tubular member in coaxial arrangement to define said annular passageway for flow of the electrical buffer fluid.

12. The method of claim 10 wherein said annular passageway is provided with an inwardly-directed ridge proximate said second end of said first tubular member to define a venturi region to induce a velocity increase in the flow of the electrical buffer fluid.

13. The method of claim 10 wherein said annular passageway is provided with an increased cross-sectional area proximate said second end of said first tubular member.

14. The method of claim 10 wherein said first tubular member is conductive whereby substantially no loss of potential occurs between said first end and said second end when a voltage is applied to said first tubular member.

15. The method of claim 10 wherein said insulating casing is a ceramic sleeve closely receiving said metallic tubular member.

16. The method of claim 10 wherein said second tubular member is fabricated from glass tubing.

* * * * *